United States Patent [19]

Kopenhaver

[11] 4,352,837

[45] Oct. 5, 1982

[54] METHOD OF MANUFACTURING ROOFING SHINGLES HAVING MULTIPLE PLY APPEARANCE

[75] Inventor: Robert L. Kopenhaver, Berwyn, Pa.

[73] Assignee: Certain-teed Corporation, Valley Forge, Pa.

[21] Appl. No.: 266,509

[22] Filed: May 22, 1981

Related U.S. Application Data

[62] Division of Ser. No. 808,171, Jun. 20, 1977, Pat. No. 4,295,445.

[51] Int. Cl.[3] ..... B05C 19/00

[52] U.S. Cl. ..... 427/187; 427/188; 427/197

[58] Field of Search ..... 427/186, 187, 188, 197; 118/310, 212, 312, 311, 304

[56] References Cited

U.S. PATENT DOCUMENTS

| | | | |
|---|---|---|---|
| 2,068,767 | 1/1937 | Robert | 427/188 |
| 2,074,131 | 3/1937 | Penley et al. | 427/188 |
| 2,074,684 | 3/1937 | Eckert | 427/187 |
| 3,104,184 | 9/1963 | Wengenroth, Jr. | 118/310 |

*Primary Examiner*—John P. McIntosh
*Attorney, Agent, or Firm*—Paul & Paul

[57] ABSTRACT

An improved apparatus for manufacturing roofing shingles having multiple ply appearance, in which an elongated strip of a dry organic or mineral material previously saturated in an asphalt tank and with at least one uniform longitudinally continuous strip of a first coating of granules is fed into the apparatus. The apparatus automatically and repeatedly applies spaced apart bands of varying widths of an adhesive material onto the first coating of granules. A second coating of granules is then automatically applied by the improved apparatus to the asphaltic bands. The application of the adhesive bands and the subsequent granule distribution are synchronized so that the granules are distributed only upon the bands of adhesive.

4 Claims, 5 Drawing Figures

METHOD OF MANUFACTURING ROOFING SHINGLES HAVING MULTIPLE PLY APPEARANCE

This is a division of application Ser. No. 808,171, filed June 20, 1977, now U.S. Pat. No. 4,295,445.

BACKGROUND OF THE INVENTION

This invention relates generally to asphaltic roofing covering, and more particularly, to an apparatus for manufacturing mineral coated asphaltic shingles having textures, colors, and cuts to simulate wood shapes or the like.

In the art of roofing shingle manufacturing, substantial efforts have been devoted to the simulation of wood or other such "natural" appearance and textures. For example U.S. Pat. Nos. 2,142,181 and 2,070,571 exemplify a class of schemes for imitating the appearance of the grain of weathered wooden shingles.

Others have sought to created the image of depth by utilizing bands of different colored grit. For example, U.S. Pat. No. 1,368,947 utilizes stripping along adjacent edges of installed shingles to give an appearance of shading caused by thickness in shake or thatched roofs. U.S. Pat. No. 1,898,989 teaches the use of different colored sequential stripes for ajacent shingles.

Also, the prior art includes another class of shingle construction wherein the lower edge of the shingles is irregularly cut or scalloped to give a random thatched appearance.

It is the object of the present invention to provide an improved apparatus for manufacturing roofing shingles which accurately imitates thatch or shake type roofing materials.

Another object of the present invention is to provide an improved apparatus for manufacturing roofing shingles which accurately imitates thatch or shake type roofing materials which is easily adapted to present shingle manufacturing apparatus.

A further object of the present invention is to provide an improved apparatus for manufacturing roofing shingles which accurately imitates thatch or shake type roofing materials which is economical and easy to operate.

These and other objects and advantages of the present invention will be apparent to those skilled in the art after a consideration of the following detailed description, taken in conjunction with the accompanying drawings in which the preferred form of this invention is illustrated.

SUMMARY OF THE INVENTION

In accordance with the principles of the present invention, an improved apparatus for manufacturing roofing shingles in which a saturated organic felt or bonded glass mat is coated with an asphaltic material, uniformly top and bottom, to a specified weight, and thereafter has mineral granules applied by a first blender to the coated surfaces of the felt or mat. The apparatus, after the application of mineral granules, automatically and periodically applies or inks transverse bands of different widths of adhesive material onto the mineral granules to provide bands of adhesive thereon. Mineral granules are then automatically applied to the inked transverse bands of the adhesive surface. After the second application of mineral granules, the material continues to proceed through the apparatus and shingles are then cut from the resulting runner of roofing in a longitudinal fashion, preferably with plural, singular shingle widths being obtained from the width of the strip. The cutting means maintains the length of the shingles constant while the difference in lengths of the repeat of the transverse bands on the runner and the length of the shingles produces a semi-random distribution of the bands on the shingles. This type of apparatus produces an almost totally random distribution of a second application of granules from the first application of granules and thereby successfully imitates the random changes of texture and color of thatch or shake type roof construction.

DETAILED DESCRIPTION OF THE PREFERRED EMBODIMENT

Figure 1:
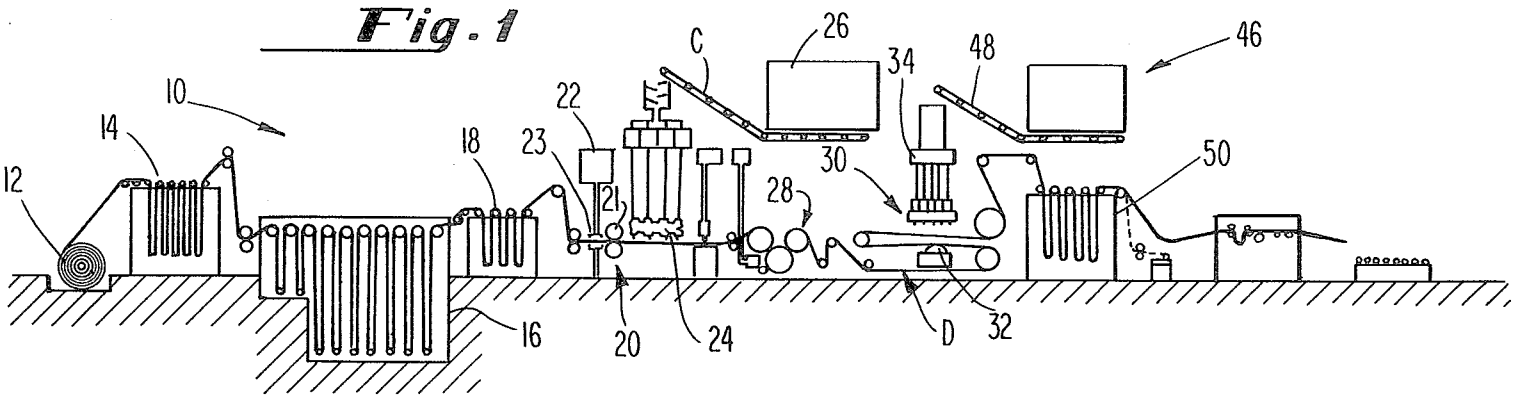
FIG. 1 is a schematic view of the improved apparatus of the present invention.

FIG. 1 illustrates generally an apparatus 10 for manufacturing roofing shingles which imitates thatch or shake type roofing materials. Specifically, FIG. 1 represents diagrammatically how raw materials are processed into finished shingles.

In operation, a roll of dry felt or bonded fiberglass mat 12 in sheet form, is installed on the feed roll and unwound onto a dry looper 14. The looper acts as a reservoir of material that can be drawn upon during the manufacturing operation thereby eliminating stoppages which would necessarily occur in attaching a new roll of felt, or when imperfections in the incoming mat of material occurs. With dry felt, after it passes through dry looper 14, it is subjected to a hot asphaltic saturating process which has as its objective the elimination of moisture and the filling of the intervening spaces of the fibers of the material as completely as possible with an asphaltic saturate. This saturating process occurs in a saturation tank 16 in which asphalt, in liquid form, is contained. After being saturated, the material then passes through wet looper 18 which assists in the saturation process by allowing the material upon cooling, to shrink naturally thereby permitting the excess asphaltic material to be drawn into the felt material.

With a glass mat, after proceeding through the dry looper, it then passes directly into coating area 20 where a coating of asphaltic material is applied, uniformly to the top and bottom of the mat until a specified weight of material has been applied to the mat. Coating area 20 contains a material reservoir 22 and distributor nozzle 23 which applies the adhesive coating material to the mat. Excess coating material flows over the sides of the felt and into a pan (not shown) from which it is picked up by adjustable rollers 21 and applied to the bottom of the felt.

When smooth roll roofing is being manufactured, talc, mica, or other suitable minerals are applied to both sides of the coated material. The mica or talc prevents adhesion of the roofing material to itself when rolled or stacked for storage. When however, mineral surfaced products are being manufactured, granules of specified color or color combinations are added from a first hopper or blender 24 and spread thickly onto the coated surfaces to form a strip or strips, as shown in FIG. 3, while the underside of the roll of material is coated with talc, mica or other suitable minerals.

Each shingle contains a first continuous coating of granules 25 comprising two (2) distinct sections or strips 27 and 29. Strip 27 is formed of a continuous layer of granules and comprises the exposed tab area of the shingle. These granules may have a single color or a blend of colors depending on the effect desired from the shingles. A head lap or second section 29 is formed on each shingle by applying, simultaneously with the application of the continuous layer of granules 27, a continuous layer of granules adjacent to layer 27 having a generally non-descriptive color. The granules applied to form the head lap are applied at lower concentrations than the granules which form the exposed tab area of the shingle.

The granules which form both the exposed tab and head lap portions of the shingle are distributed from hopper 24. This hopper is fed from a mineral granule storage receptical 26 which supplies granules to hopper 24 by means of conveyor C. The function of granule hopper 24 is to apply the first continuous coatings of granules 27 and 29, mentioned hereinabove, onto the felt. After the first continuous coatings of granules is applied to the sheet of material, as shown in FIG. 3, it is then run through a series of press and cooling rollers or drums, generally designated as items 28 in FIG. 1. Further, in order to insure proper adhesion of the granules, the sheet and the granules are subjected to controlled pressure which forces the granules into the asphaltic coating material to a predetermined desired depth. At this point, the sheet is cooled prior to passing into the mechanism for automatically applying the repeat series of spaced apart bands of granules 30.

Figure 3:
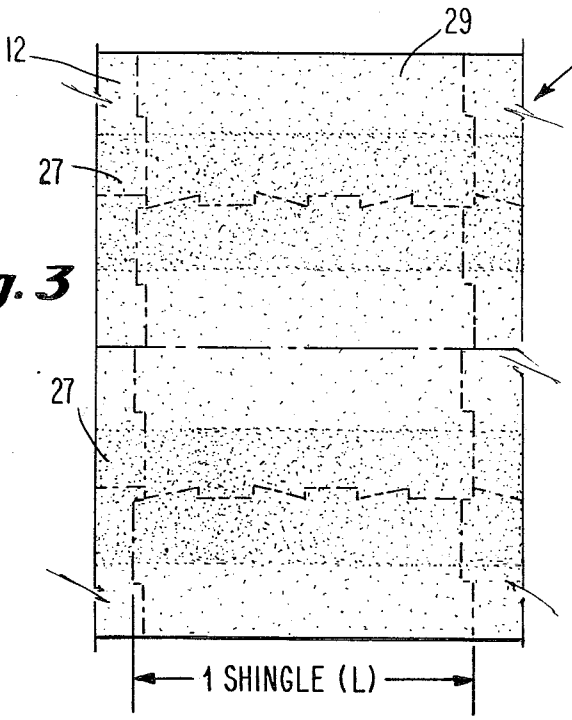
FIG. 3 is a view taken along line 3 of FIG. 2.

This mechanism consists of conveyor D which directs the sheet of material which has been previously coated, see FIG. 3, around inking wheel 32 which in the preferred embodiment, applies bands of coating asphalt onto strip 27 of the first continuous coating of granules. These bands are "inked" in series which are repeated periodically along the continuous first strip of granules at a periodicity different from the length of shingle L, illustrated in FIGS. 3 and 4 in phantom. After the material passes over the inking wheel 32 it then passes beneath a second granule blender 34 which contains a series of granule distribution conduits 36, 38, 40, 42, and 44, shown in FIG. 2. The distribution conduits extend across the sheet of material to deposit granules of material on the previously inked bands of the sheet.

Granules are continuously supplied to the conduits from storage bin 46 by conveyor 48. After the sheet has been coated with the repeated bands of granules, the sheet then passes through the finish or cooling looper 50. The function of this looper is to cool the sheet to a point where it can be easily cut and packaged without danger to the sheet.

Figure 4:
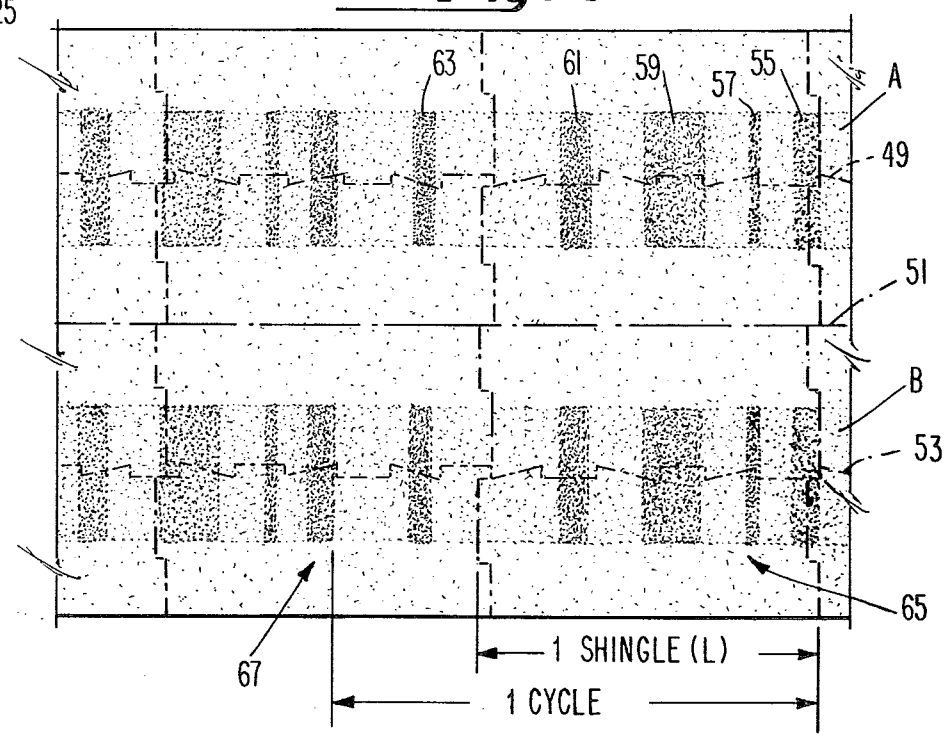
FIG. 4 is a view taken along line 4 of FIG. 2.

Finally, after proceeding from the cooling looper the sheet of material is then cut by a cutting cylinder. This cylinder cuts the sheets from the bottom or smooth side along lines 49, 51 and 53, shown in phantom in FIGS. 3 and 4. In the embodiment shown, the cuts 49 and 53 are of a "saw tooth" design to provide exposed edge cuts which simulate the appearance of shakes. Other straight or irregular cuts may optionally be used as desired. As noted in FIG. 4, the bands of granules 55, 57, 59 and 61 are applied at a periodicity different in length than shingle length L. The bands are applied in periodically recurring series, each series having, for example, five bands, 55, 57, 59, 61 and 63 of sundry width and spacing, with each repeat being greater or less in length than the desired and uniformly maintained shingle length L. Bands 55, 57, 59, 61 and 63 are repeated as illustrated in FIG. 4. The bands of the upper and lower series A and B, respectively, are identical to each other. It will be appreciated from the drawings, that the variable repetition rate of the "inking cycle" in conjunction with the uniform shingle length produces individual shingles having very different appearances. Compare, for example, shingles 65 and 67.

After the shingles have been cut they are separated and accumulated into stackes having the proper number for packaging.

It is important to note that the process and apparatus for fabricating roofing shingles described generally in reference to FIG. 1, involves conventional aspects of shingle fabrication, in accordance with methods known and approved in the art, except for the apparatus for automatically and periodically applying a repeated series of spaced apart bands of granules on at least one previously applied continuous layer of granules.

MECHANISM FOR APPLYING THE REPEAT SERIES OF SPACED APART BANDS OF GRANULES

Figure 2:
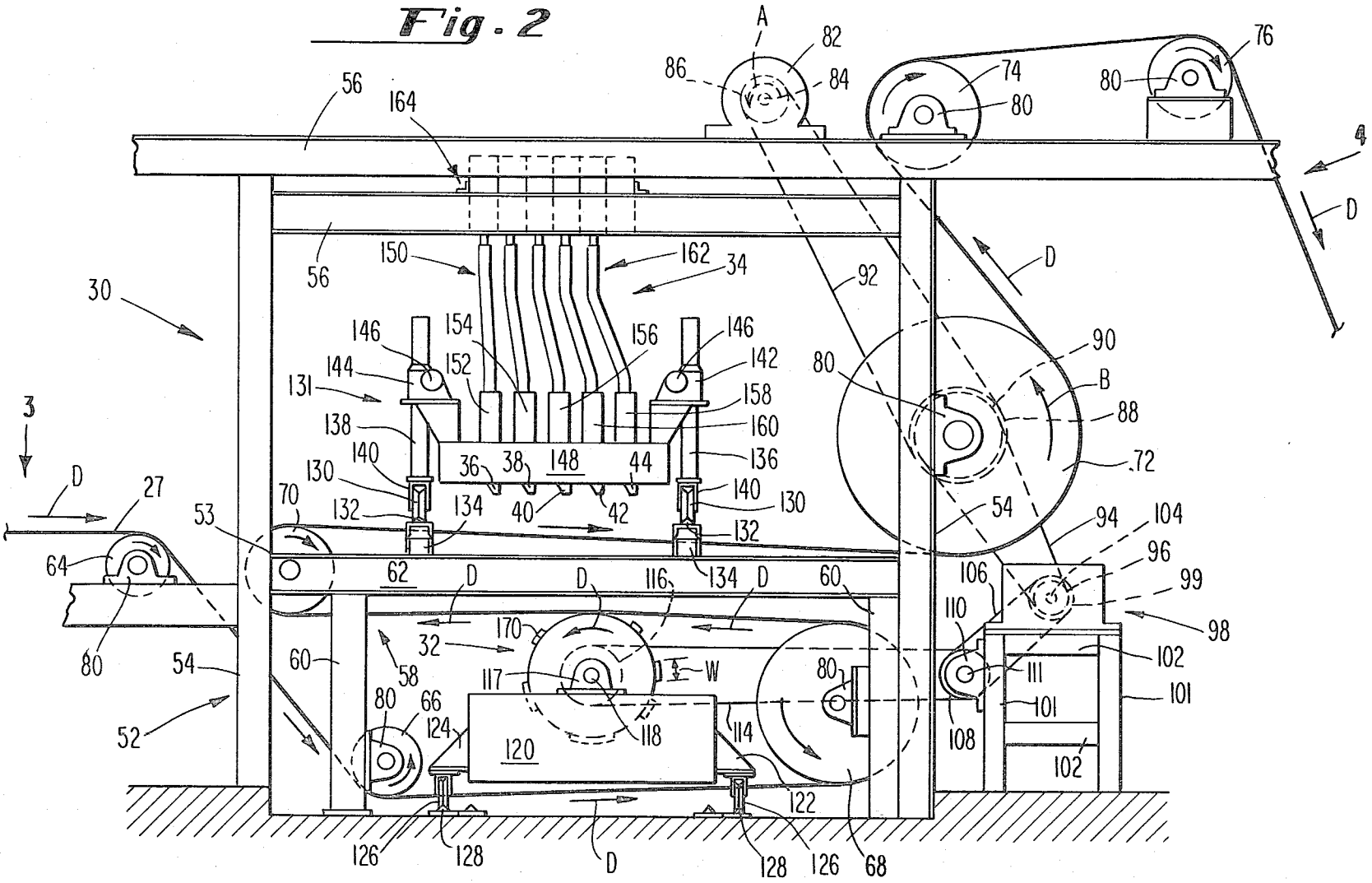
FIG. 2 is an enlarged view of the mechanism for applying a repeated series of spaced apart bands of granules to the mat of material.

FIG. 2 illustrates the apparatus for automatically applying a repeated series of spaced apart bands of granules 30, having varying widths. Material 12 which has been previously coated with a first continuous coating of granules 25 consisting of mineral granules 27 and 29, as shown in FIG. 3, proceeds into apparatus 30. This apparatus consists of main frame 52 having upstanding vertical support members 54 interconnected by horizontal channel members 56 so as to form a generally square shaped main frame. A second subframe 58 comprised of vertical support members 60 interconnected by horizontal support channel 62 is positioned approximately midway between the top and bottom of main frame 52. Mounted to frames 52 and 58 are a series of rollers 64, 66, 68, 70, 74 and 76 which support, guide and direct the incoming sheet of material through apparatus 30. A surfacing drum 72 also acts to guide and direct the material through the apparatus. These guide rollers, as well as drum 72, (with the exception of roller 70) are supported for rotation by clevises 80 mounted to both the main and subframes 52 and 58, respectively. Roller 70 is rotatably mounted to channel 62.

These rollers and drum 72 are driven by motor 82 mounted to the uppermost horizontal support 56 of the main frame assembly. This motor has connected to its output drive shaft 84 a drive sprocket 86. Surfacing drum 72 has secured to it a pair of sprockets 88 and 90, respectively. A drive chain 92 is positioned around drive sprocket 86 and around sprocket 88. Therefore, as drive sprocket 86 rotates in the direction indicated by arrow A it imparts a simultaneous and direct rotation to sprocket 88 and thereby drum 72 in the direction indicated by arrow B. Drum 72 drives the sheet of material and causes the material to proceed on rollers 64, 66, 68, 70, 74 and 75 in the direction indicated by arrow D. Further, surfacing drum 72 acts to recirculate excess granules applied to, but unsecured to, the material thereby assuring complete coverage of the mat by the granules.

As previously stated, a smaller sprocket 90 is also rigidly secured to drum 72 such that rotational movement will be imparted to this sprocket as drum 72 is driven. Drive chain 94 has one end positioned around sprocket 90 and its other end around sprocket 96 mounted to shaft 104 of speed differential 98. Speed differential 98 is mounted to table 100 which has a generally rectangular shape and consists of vertical member 101 and horizontal member 102. Sprocket 99 (larger than sprocket 96) is also rigidly mounted to shaft 104 and has drive chain 106 positioned therearound. Drive chain 106 proceeds around sprocket 108 rigidly mounted on shaft 111 which is rotatably mounted in clevis 110. This clevis is secured to vertical support 101 of table 100. Also secured to shaft 111 is another sprocket (not shown) around which inking wheel drive chain 114 is secured. The other end of drive chain 114 is secured to sprocket 116 rigidly mounted to shaft 118 which is rotatably mounted in clevis 117.

Also secured to shaft 118 is inking wheel 32. Therefore, as the sprocket 116 is rotated by drive chain 114, so therefore, is shaft 118 and inking wheel 32 rotated. Inking wheel 32 has a single orientation to shaft 118 so that coordination of inked sections and granule drops are maintained whenever the inking wheel is removed for maintenance, replacement, etc.

Clevis 117 is mounted to and extends above the upper-most portion of trough 120. This trough has mounted to it a pair of lateral extensions 122 and 124 which contain wheels 126 which roll on tracks 128 so as to be movable laterally relative to the sheet of material. Trough 120 contains an asphaltic adhesive material. The inking wheel 32 contains a plurality of extensions 170 spaced varying distances apart from each other and mounted to and extending from the periphery of the wheel. These extensions vary in width W, so that upon rotation of wheel 32 varying widths of adhesive are applied to the incoming sheet. As noted in FIG. 2, six (6) extensions are mounted to wheel 32, but any number may be so mounted.

Second granule blender 34 consists of frame 131, mounted by wheels 130 to tracks 132. These tracks are rigidly secured to channel members 134. Each channel member is rigidly secured by welding or the like, to horizontal channel member 62 of subframe 58. These wheels permit movement of this blender across the sheet of material, whenever necessary. Shafts 136 and 138 are mounted to wheel supports 140 and extend upwardly therefrom. Positioned over the shafts are collars 142 and 144. These collars are adapted to be raised and lowered by means of hand screws 146. The four screws are linked together (not shown) so that operating one operates all four simultaneously. Collars 142 and 144 extend from horizontal supporting member 148 of blender frame 131. This member acts to support granule distributing header 150.

This header consists of a plurality of granule conduits 152, 154, 156, 158 and 160. Therefore, as illustrated in FIG. 2, the number of extensions of the inking wheel, six (6) does not equal the number of granule conduits, five (5). As previously mentioned, it is advisable to supply excess granules onto the coated surface to insure complete coverage of the adhesive coated surfaces. The excess granules applied by the five (5) granule conduits are applied to the sixth inked band by the surfacing drum 72 which continuously recirculates excess granules onto the mat. These conduits are connected by means of granule flow tubes 162 to a first granule supply reservoir 164. This first reservoir is supplied by granule supply reservoir 46 and conveyor 48, as shown in FIG. 1.

Each of the granule conduits 152, 154, 156, 158 and 160 may be supplied with different color granules so that different color mixes of granules from the first mix of the continuous coating of granules, may be applied to the various size bands of adhesive. By synchronizing the rotation of the extensions of the inking wheel to the opening of various granule conduits it enables the conduits to supply granules upon the inked bands on the top surface of the sheet of material. It should be noted that in the preferred embodiment, only the exposed tab portion of the first continuous coating of granules of the shingle has applied to it the random strips of adhesive and granules. However, in some instances, it may be desirable to apply the random strips of adhesive and granules across both the exposed tab and head lap portions of the shingle. The extensions of the random strips can be accomplished by the present invention by appropriately extending the width of the granule conduits and the extensions on the inking wheel.

CONTROL SYSTEM

Figure 5:
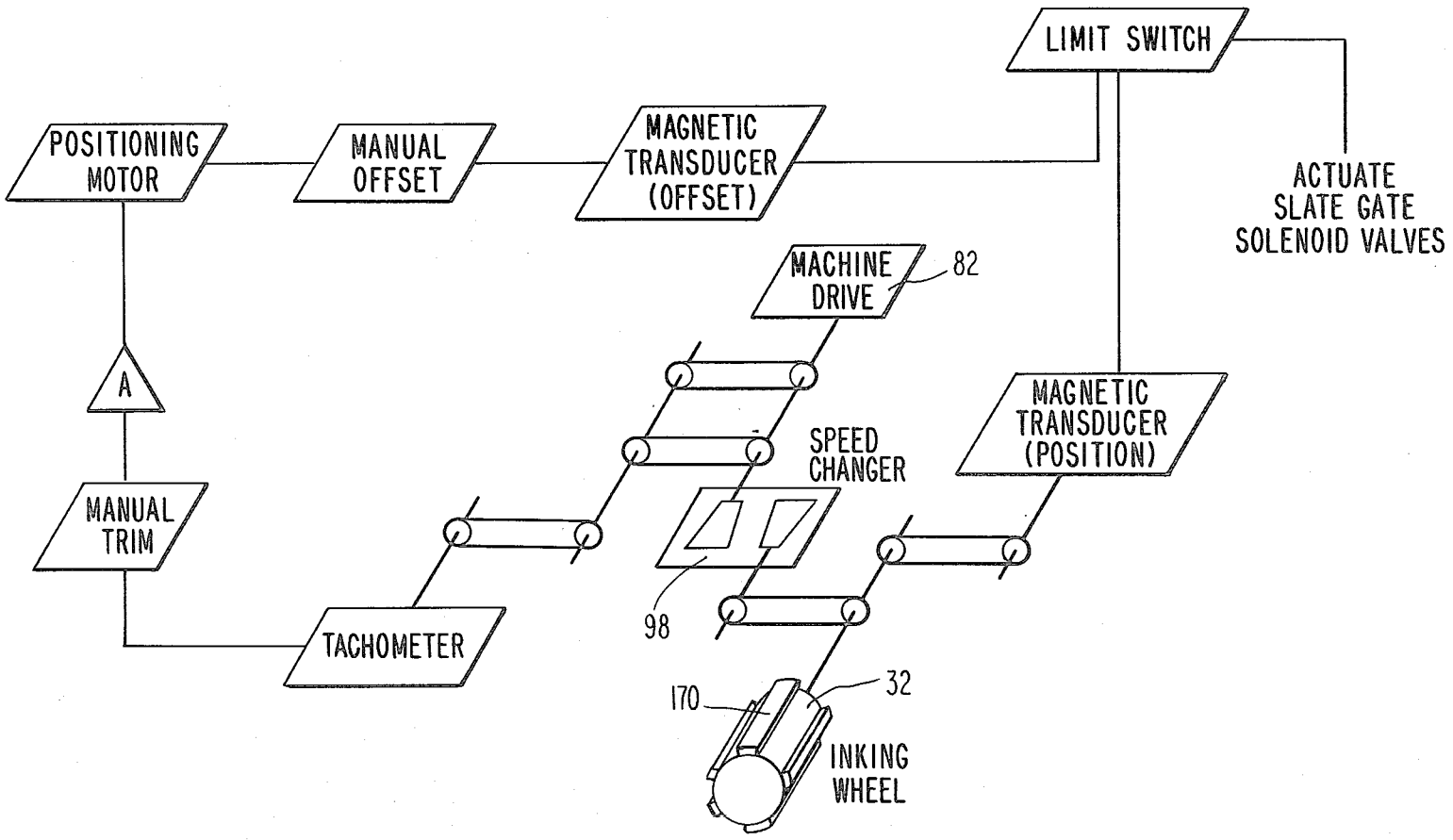
FIG. 5 is a schematic view of the control system of the present invention.

The control system which synchronizes and operates the granule conduits with respect to the inking wheel is illustrated in FIG. 5 and operates as follows.

As illustrated in FIG. 5, the machine drive, motor 82, is connected to a speed changer, differential 98. The inking wheel 32 is driven from the speed changer through sprockets and drive chains, as previously described. The rotation of the inking wheel is directly monitored by a magnetic transducer.

As previously described, when an extension of the inking wheel contacts the sheet of material, as illustrated in FIG. 2, the magnetic transducer produces a signal which activates the solenoid which controls the gate valve associated with the granule conduit that corresponds to the particular extension of the wheel. For example, when the extension labeled 170 on FIG. 5 contacts the first layer of granules it causes an electrical signal to be produced by the magnetic transducer which activates the solenoid which controls (opens) the gate valve contained in granule conduit 152, see FIG. 2. This gate valve will remain open until such time as the signal produced by the transducer, generated by the position of the wheel, indicates that the valve is to close, at which time the solenoid is deactivated. This type of operation permits a particular color mix of granules contained in one of the granule conduits to be distributed on a particular size band of adhesive applied by one of the extensions on the inking wheel.

The control system incorporates a means for adjusting the system, either automatically or manually, to control the duration the gate valves remain open relative to the speed at which the material proceeds from the inking wheel to and through blender 34. This adjusting system assures proper distribution of granules on the adhesive bands.

A tachometer for recording and monitoring the speed of the output of the machine drive, motor 82, is operably associated with the motor, as shown in FIG. 5. This tachometer provides automatic register shift to compensate for speed changes. The magnitude of the register shift is further controllable by the manual trim. The register shift can also be obtained manually by changing the elevation of the conduits (using knobs 146) which changes the time required for the granules to travel from the conduit to the sheet of material. Provision is also made to provide larger gate openings at higher speeds to compensate for the shorter periods of time the gates are open.

While the preferred structure in which the principles of the present invention have been incorporated is shown and described above, it is to be understood that the invention is not to be limited to the particular details, shown and described above, but that, in fact, widely different means may be employed in the practice of the broader aspects of the present invention.

What is claimed is:

1. An improved method for manufacturing roofing shingles from dry roofing material comprising, the steps of, continuously feeding dry roofing material, saturating the dry roofing material with asphalt, automatically applying a first uniform, longitudinal adhesive coating to the previously saturated material, automatically applying a first continuous coating of granules to said adhesive coating, and cutting said material into shingles of a given length and a given width, wherein the improvement comprises, after the applying of the first coating of granules and prior to cutting said material into shingles, the step of automatically and periodically applying a repeated series of spaced apart bands of adhesive upon the first coating of granules, with the series of bands of adhesive material having various widths and being periodically applied at a predetermined periodicity such that the series of bands are applied to the first coating of granules over a length different than the given length of the shingle, whereby varying portions of said series of bands will be present on each of said given lengths of shingles, and automatically distributing granules in conjunction with the applying of the bands of adhesive such that granules are only distributed upon said bands of adhesive.

2. An improved method for manufacturing roofing shingles from dry roofing material comprising, the steps of, continuously feeding dry roofing material, saturating the dry roofing material with asphalt, automatically applying a first uniform, longitudinal adhesive coating to the previously saturated material, automatically applying a first continuous coating of granules to said adhesive coating, and cutting said material into shingles of a given length and a given width, wherein the improvement comprises, after the applying of the first coating of granules and prior to cutting said material into shingles, the step of automatically and periodically applying a repeated series of spaced apart bands of granules to the first continuous coating of granules, said series of bands having various widths and being periodically applied along said first continuous coating at a predetermined periodicity such that the series of bands are applied to the first coating of granules over a length different than the given length of the shingle, whereby varying portions of said series of bands will be present on each of said given lengths of shingles.

3. The method of claim 2, wherein the step of applying a first continuous coating of granules comprises the applying of two distinct sections of granules positioned adjacent each other.

4. The method of claim 2, wherein the step of applying a repeated series of spaced apart bands of granules comprises the substeps of conveying material having a first coating of granules thereon into and through a zone in which the series of bands of granules are applied, and automatically, periodically applying bands of varying widths of adhesive to the first continuous coating of granules over a length different than the given shingle length, then automatically distributing granules on to the bands of adhesive; and synchronizing and controlling the application of the bands of adhesive and the distribution of granules on to these bands of adhesive, so that the granules are distributed only on the bands of adhesive.

* * * * *